US005778450A

United States Patent [19]

Hagestad et al.

[11] Patent Number: 5,778,450

[45] Date of Patent: Jul. 14, 1998

[54] BIB AND TRAY

[76] Inventors: Christian A. Hagestad, 3522 W. 29th St., Minneapolis, Minn. 55416; Choon M. Choi, 2820 Girard Ave. S., Minneapolis, Minn. 55408

[21] Appl. No.: 759,207

[22] Filed: Dec. 5, 1996

[51] Int. Cl.[6] ..... A45F 5/00; A45F 5/04

[52] U.S. Cl. ..... 2/49.3; 2/46; 2/49.1; 224/201; 224/148.7; 224/270

[58] Field of Search ..... 2/46, 48, 49.1, 2/49.2, 49.3, 49.4, 49.5, 50, 51, 52, 75, 80, 174; 108/43, 44; 224/148.1, 148.4; 148.7, 270, 201, 265, 901, 906

[56] References Cited

U.S. PATENT DOCUMENTS

| | | | |
|---|---|---|---|
| 3,115,639 | 12/1963 | Moszczynski | 2/48 |
| 3,330,227 | 7/1967 | Yachuk | 108/44 |
| 3,361,091 | 1/1968 | Inman | 224/270 |
| 4,660,224 | 4/1987 | Ashcraft | 2/48 |
| 4,946,094 | 8/1990 | Stang | 224/270 |
| 5,075,897 | 12/1991 | Daniels | 2/48 |
| 5,107,545 | 4/1992 | Potter | 2/48 |
| 5,181,275 | 1/1993 | Spulgis | 2/48 |
| 5,520,119 | 5/1996 | Eisenberg | 108/43 |

FOREIGN PATENT DOCUMENTS

| | | | |
|---|---|---|---|
| 1443353 | 5/1965 | France | 2/48 |

*Primary Examiner*—Jeanette E. Chapman

[57] ABSTRACT

A bib with a closure is attached to a lap tray positioned on a users lap.

5 Claims, 1 Drawing Sheet

BIB AND TRAY

FIELD OF THE INVENTION

The present invention relates generally to a bib and tray combination for use while consuming food.

DESCRIPTION OF THE PRIOR ART

Disposable bib tray products are known from U.S. Pat. No. 4,114,199 among others. These products are used to facilitate eating in various settings. However there are numerous problems associated with spillage because of the design and construction of conventional bib and tray systems.

SUMMARY OF THE INVENTION

The bib tray of the present invention is especially useful for eating while in a moving car. The system includes a wearable bib which can be connected to a lap tray. The lap tray has various depressions and cut outs to facilitate use in a car.

BRIEF DESCRIPTION OF THE DRAWINGS

In the drawings identical reference numerals indicate corresponding structure throughout the view, wherein.

DETAILED DESCRIPTION OF THE INVENTION

The figures show an illustrative example of the invention and various modifications can be made to the structures without departing from the scope of the invention.

Figure 1:
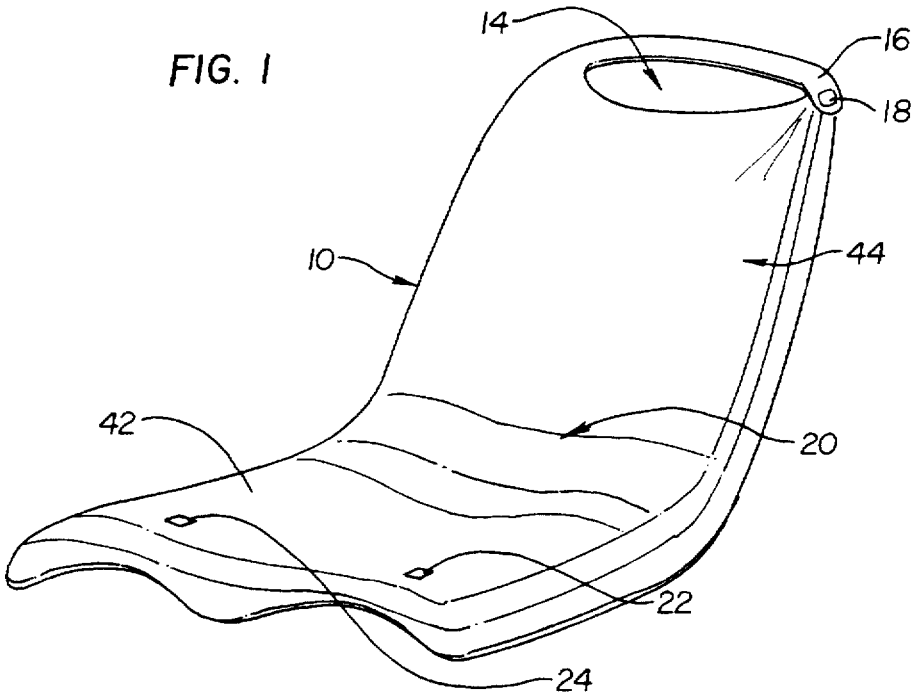
FIG. 1 is a perspective view of the bib portion of the combination.
Figure 2:
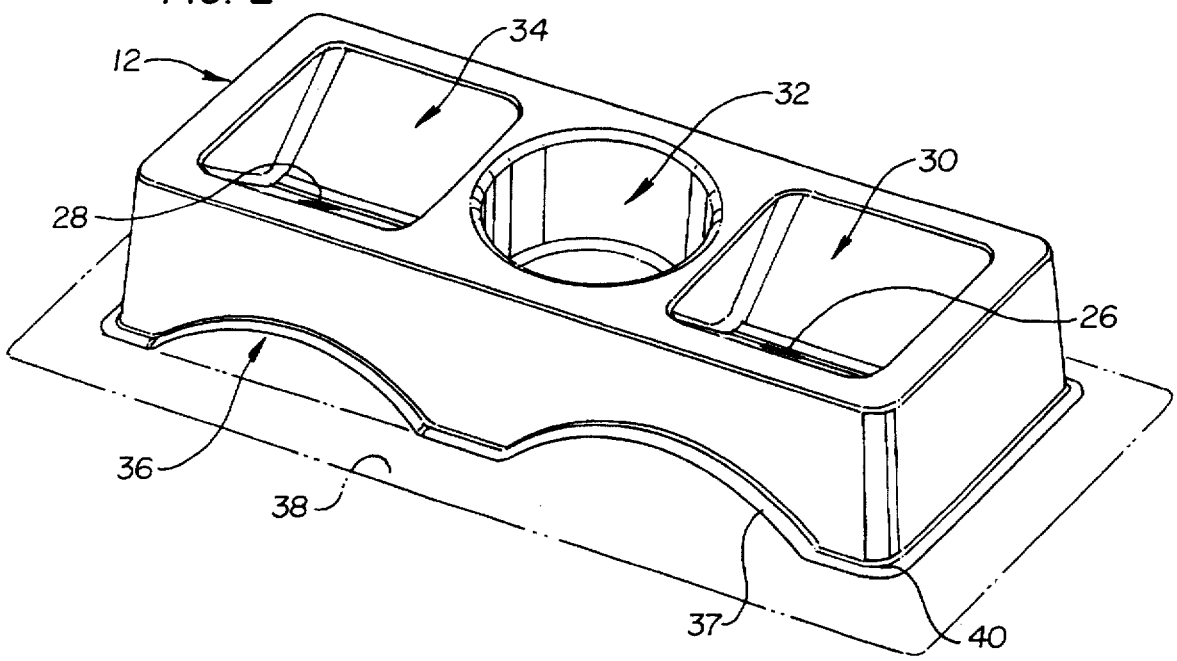
FIG. 2 is a perspective view of an illustrative tray portion of the combination.

FIG. 1 shows a bib 10 which is preferably used in combination with the tray 12 shown in FIG. 2. In use, the user will put the bib 10 on by fastening the neck closure 18 which creates the neck aperture shown by numeral 14. The generally rectangular shape of the bib 10 will drape with a crease 20 at the lap of the user dividing the bib 10 into a chest portion 44 and a leg portion 42. The leg portion 42 of the of the bib will lie along the legs of the user and provide anchor points shown as Velcro strip 22 and 24 at the tops of the leg of the user. It should be clear that other closure materials can be used and that other positions for the anchor are operable. However it is desirable to use two anchor points and locate them where they are readily accessible.

FIG. 2 shows an exemplary tray with three compartments shown as food compartment 34, drink compartment 32, and food compartment 30. It is preferred to provide complementary Velcro anchors 28 and Velcro anchor 26 for attachment to the bib 10 portion of the combination. The lower surface of the tray 12 includes a flange features 40 which allows the tray to rest on a planar surface 38. It is also desirable to have complementary leg cutouts 36 and 37 to help position and stabilize the tray on the legs of the user. The exact shape of the leg cutout can be varied but will generally be semicircular. The depth of the food compartments may be varied within the scope of the invention but it is preferred to have a drink compartment extend as low as possible so that the relatively heavy drink rests between the top of the users legs helping to stabilize the tray and bib combination.

What is claimed is:

1. A combination bib and tray system comprising a bib and a tray;

said bib comprising a substantially rectangular sheet of flexible material having a neck piece forming a neck aperture with a neck closure located off the center with respect to said neck aperture; said bib is divided into a chest portion and a leg portion;

said tray including a pair of leg recesses which are complementary leg cutouts to aid in positioning and stabilizing the tray on the legs in a seated position;

said tray also including a plurality of compartments for holding food wherein at least one compartments extends below the level of the top of the users legs in a seated position; and said combination including at least one anchor for connecting the tray to the bib.

2. The bib and tray combination of claim 1 wherein said compartments are odd in number and symmetrically arranged around a users legs when said user is in the seated position.

3. The bib and tray combination of claim 1, wherein the center compartment extends between the users legs.

4. The bib and tray combination of claim 1 wherein at least one of said compartments is circular in cross section.

5. The bib and tray combination of claim 1 wherein the center compartment is circular in cross section.

* * * * *